US008710474B2

(12) United States Patent
Kodama et al.

(10) Patent No.: US 8,710,474 B2
(45) Date of Patent: Apr. 29, 2014

(54) EXTREME ULTRAVIOLET LIGHT GENERATION APPARATUS

(75) Inventors: Takeshi Kodama, Hiratsuka (JP); Osamu Wakabayashi, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 108 days.

(21) Appl. No.: 13/532,365

(22) Filed: Jun. 25, 2012

(65) Prior Publication Data

US 2013/0062538 A1 Mar. 14, 2013

(30) Foreign Application Priority Data

Sep. 13, 2011 (JP) ..... 2011-199828

(51) Int. Cl.
*G21K 5/00* (2006.01)
*G01K 5/00* (2006.01)
*B41C 3/02* (2006.01)

(52) U.S. Cl.
USPC ..... 250/504 R; 250/461.1; 164/3; 164/452; 164/457

(58) Field of Classification Search
USPC ..... 250/461.1, 492.1, 493.1, 503.1, 504 R; 164/3, 48, 53, 61–63, 119, 151, 155.3, 164/154.1, 157, 255, 250.1, 258, 439, 452, 164/457, 485, 488, 505
See application file for complete search history.

(56) References Cited

U.S. PATENT DOCUMENTS

| | | | | |
|---|---|---|---|---|
| 4,495,982 | A * | 1/1985 | Kaneko et al. | 164/452 |
| 4,664,175 | A * | 5/1987 | Yanagimoto et al. | 164/455 |
| 5,913,358 | A * | 6/1999 | Chadwick | 164/457 |
| 6,247,521 | B1 * | 6/2001 | Kawai et al. | 164/457 |
| 8,497,489 | B2 * | 7/2013 | Yabu et al. | 250/504 R |
| 2011/0310365 | A1 * | 12/2011 | Yabu et al. | 355/30 |
| 2012/0241650 | A1 * | 9/2012 | Yabu et al. | 250/504 R |
| 2013/0277452 | A1 * | 10/2013 | Yabu et al. | 239/102.1 |

* cited by examiner

*Primary Examiner* — Bernard E Souw
(74) *Attorney, Agent, or Firm* — McDermott Will & Emery LLP

(57) ABSTRACT

An apparatus used with an external laser apparatus for generating extreme ultraviolet light includes a target storage unit for storing a target material, a nozzle unit having a through-hole in communication with the interior of the storage unit through which the target material is outputted, an electrode having a through-hole facing the nozzle unit, and a target detector for detecting a target formed of the target material and outputting a detection signal. A direct current voltage adjuster applies and adjusts a direct current between the target material and the electrode, a pressure adjuster applies and adjusts a pressure to the target material through gas, and a controller controls at least one of the direct current voltage adjuster and the pressure adjuster based on the detection signal from the target detector.

7 Claims, 11 Drawing Sheets

EXTREME ULTRAVIOLET LIGHT GENERATION APPARATUS

CROSS-REFERENCE TO RELATED APPLICATION

The present application claims priority from Japanese Patent Application No. 2011-199828 filed Sep. 13, 2011.

BACKGROUND

1. Technical Field

This disclosure relates to an extreme ultraviolet (EUV) light generation apparatus.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

An apparatus according to one aspect of this disclosure, which may be used with an external laser apparatus, for generating extreme ultraviolet light may include: a target storage unit configured to store a target material thereinside; a nozzle unit having a through-hole through which the target material stored inside the target storage unit is outputted, the through-hole formed therein being in fluid communication with the interior of the storage unit; an electrode facing the nozzle unit, the electrode having a through-hole formed therein; a target detector configured to detect a target formed of the target material and output a detection signal; a chamber in which extreme ultraviolet light is generated; a direct current voltage adjuster configured to apply a direct current between the target material and the electrode, the direct current voltage adjuster being capable of adjusting the direct current; a pressure adjuster configured to apply a pressure to the target material through gas, the pressure adjuster being capable of adjusting the pressure; and a controller configured to control at least one of the direct current voltage adjuster and the pressure adjuster based on the detection signal from the target detector.

BRIEF DESCRIPTION OF THE DRAWINGS

Hereinafter, selected embodiments of this disclosure will be described with reference to the accompanying drawings.

DESCRIPTION OF PREFERRED EMBODIMENTS

Figure 1:
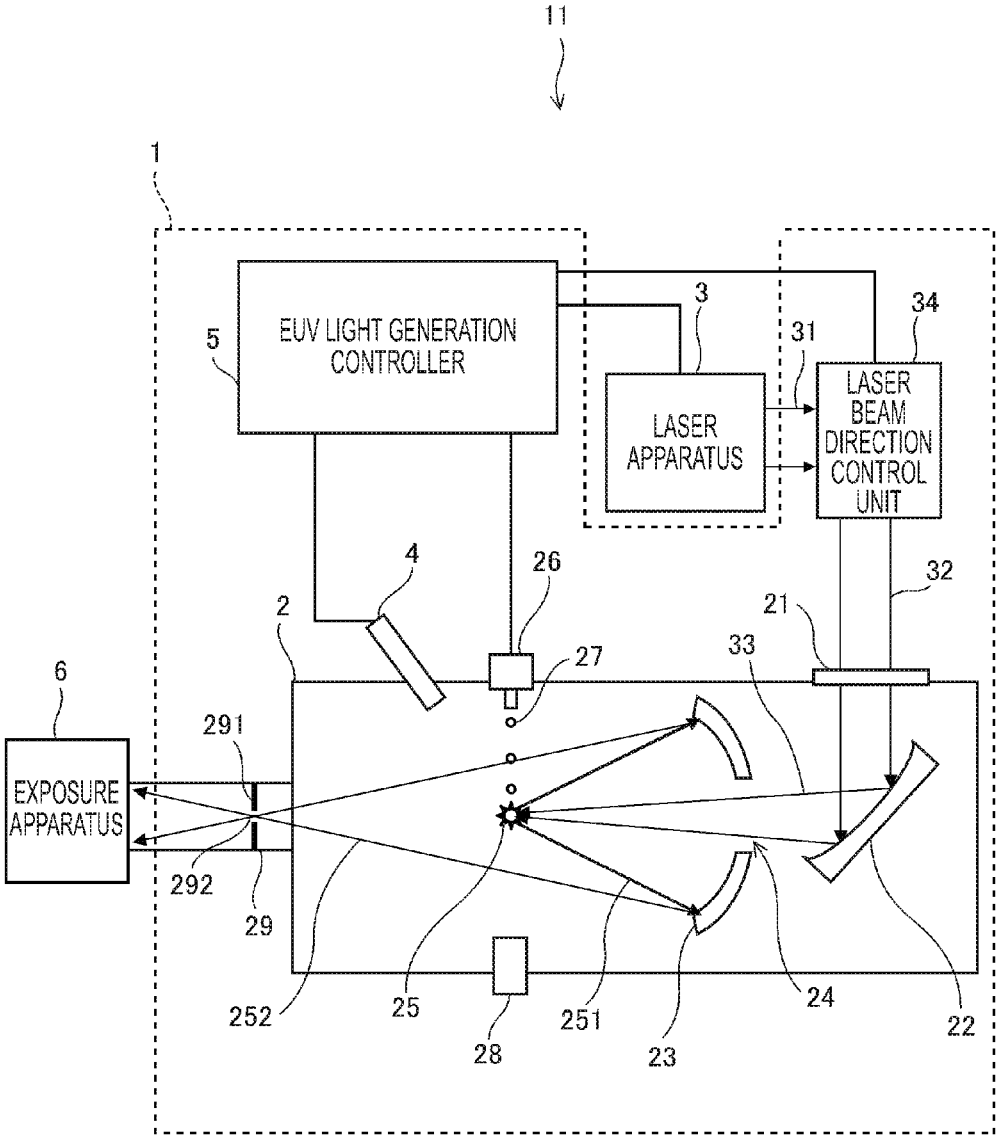
FIG. 1 schematically illustrates the configuration of an exemplary LPP type EUV light generation system.

Hereinafter, selected embodiments of this disclosure will be described in detail with reference to the accompanying drawings. The embodiments to be described below are merely illustrative in nature and do not limit the scope of this disclosure. Further, the configuration(s) and operation(s) described in each embodiment are not all essential in implementing this disclosure. Note that like elements are referenced by like reference numerals and characters, and duplicate descriptions thereof will be omitted herein.

Contents

1. Overview
2. Overview of EUV Light Generation System
2.1 Configuration
2.2 Operation
3. EUV Light Generation System Including Electrostatic-Pull-Out Type Target Supply Unit
3.1 Configuration
3.2 Operation
3.3 Effect
4. Electrostatic-Pull-Out Type Target Supply Unit
4.1 Configuration
4.2 Operation
5. Operation Examples of EUV Light Generation System
6. Variations of Target Detector
6.1 Optical Target Detector: First Variation
6.2 Optical Target Detector: Second Variation
6.3 Magnetic Circuit Target Detector 7. Variation of Target Supply Unit
7.1 Configuration
7.2 Operation
7.3 Effect
8. Supplementary Description
8.1 Detection of Charged Target through Magnetic Circuit
1. Overview In an LPP type EUV light generation system used with an exposure apparatus, a target material outputted from a target supply unit in the form of droplets may be irradiated with a pulse laser beam to be turned into plasma, and EUV light emitted from the plasma may be outputted to the exposure apparatus. In order to stabilize the energy of the outputted EUV light, a variation in the size of the droplet of the target material outputted from the target supply unit or a variation in the position of the target in a plasma generation region may preferably be small.

2. Overview of EUV Light Generation System
2.1 Configuration

FIG. 1 schematically illustrates the configuration of an exemplary LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As illustrated in FIG. 1 and described in detail below, the EUV light generation system 11 may include a chamber 2, a target supply unit 26, and so forth. The chamber 2 may be sealed airtight. The target supply unit 26 may be mounted to the chamber 2 to penetrate a wall of the chamber 2. A target material to be supplied by the target supply unit 26 may include, but is not limited to, tin, terbium, gadolinium, lithium, xenon, or any combination thereof.

The chamber 2 may have at least one through-hole formed in its wall, and a pulse laser beam 32 may travel through the through-hole into the chamber 2. Alternatively, the chamber 2 may be provided with a window 21, through which the pulse laser beam 32 may travel into the chamber 2. An EUV collector mirror 23 having a spheroidal surface may be provided inside the chamber 2, for example. The EUV collector mirror 23 may have a multi-layered reflective film formed on the spheroidal surface thereof. The reflective film may include a molybdenum layer and a silicon layer being laminated alternately. The EUV collector mirror 23 may have a first focus and a second focus, and preferably be positioned such that the first focus lies in a plasma generation region 25 and the second focus lies in an intermediate focus (IF) region 292 defined by the specification of an external apparatus, such as an exposure apparatus 6. The EUV collector mirror 23 may have a through-hole 24 formed at the center thereof, and a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, the trajectory, and the position of a target 27.

Further, the EUV light generation system 11 may include a connection part 29 that allows the interior of the chamber 2 to be in communication with the interior of the exposure apparatus 6. A wall 291 having an aperture may be provided inside the connection part 29, and the wall 291 may be positioned such that the second focus of the EUV collector mirror 23 lies in the aperture formed in the wall 291.

The EUV light generation system 11 may also include a laser beam direction control unit 34, a laser beam focusing mirror 22, and a target collector 28 for collecting targets 27. The laser beam direction control unit 34 may include an optical element for defining the direction into which the pulse laser beam 32 travels and an actuator for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as a pulse laser beam 32 after having its direction optionally adjusted. The pulse laser beam 32 may travel through the window 21 and enter the chamber 2. The pulse laser beam 32 may travel inside the chamber 2 along at least one beam path, be reflected by the laser beam focusing mirror 22, and strike at least one target 27 as a pulse laser beam 33.

The target supply unit 26 may be configured to output the target(s) 27 toward the plasma generation region 25 inside the chamber 2. The target 27 may be irradiated with at least one pulse of the pulse laser beam 33. Upon being irradiated with the pulse laser beam 33, the target 27 may be turned into plasma, and rays of light including EUV light 251 may be emitted from the plasma. The EUV light 251 may be reflected selectively by the EUV collector mirror 23. EUV light 252 reflected by the EUV collector mirror 23 may travel through the intermediate focus region 292 and be outputted to the exposure apparatus 6. The target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of the timing at which the target 27 is outputted and the direction into which the target 27 is outputted. Furthermore, the EUV light generation controller 5 may be configured to control at least one of the timing at which the laser apparatus 3 oscillates, the direction in which the pulse laser beam 32 travels, and the position at which the pulse laser beam 33 is focused. It will be appreciated that the various controls mentioned above are merely examples, and other controls may be added as necessary.

Figure 2:
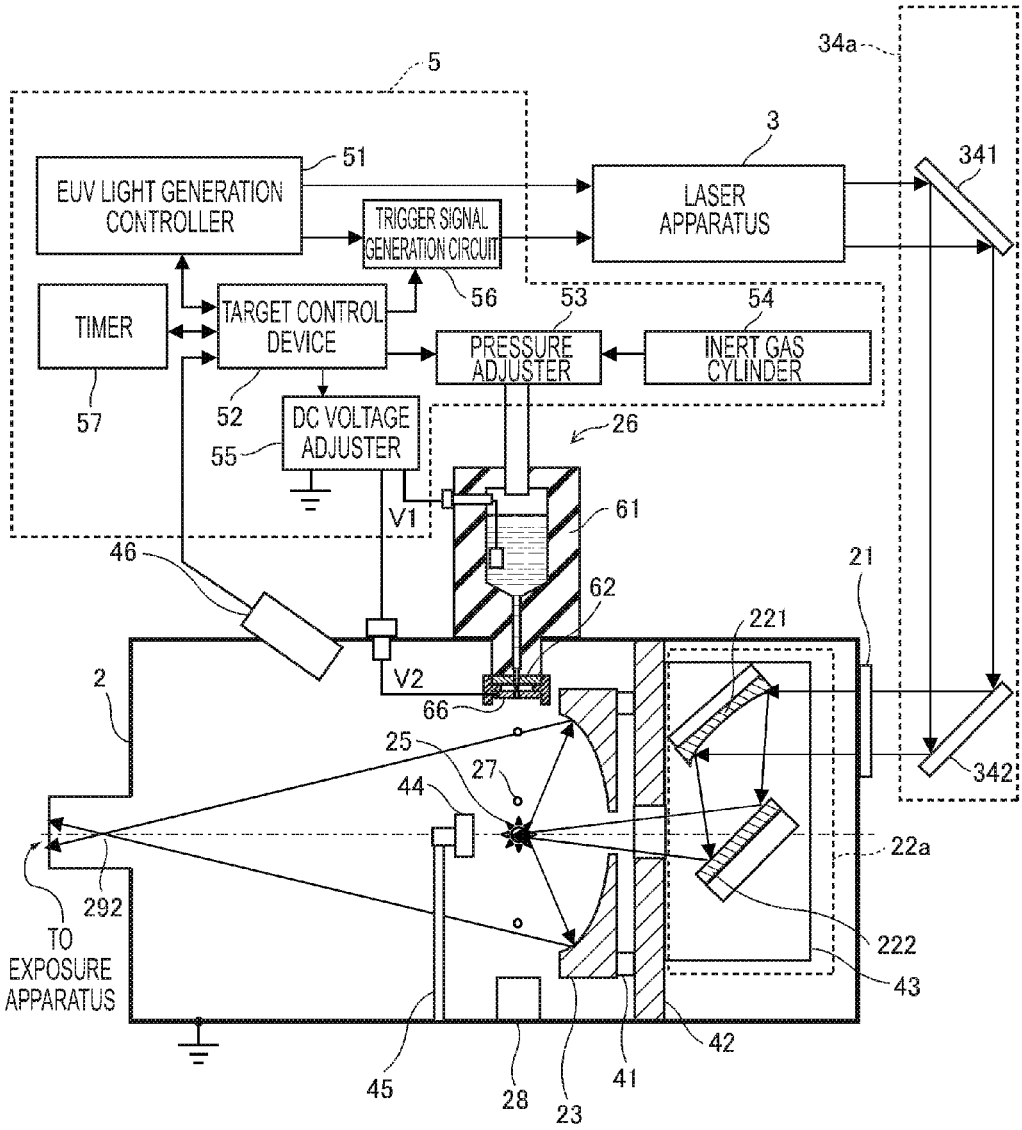
FIG. 2 is a partial sectional view illustrating an example of the configuration of an EUV light generation system according to an embodiment of this disclosure.

3. EUV Light Generation System Including Electrostatic-Pull-Out Type Target Supply Unit
3.1 Configuration FIG. 2 is a partial sectional view illustrating an example of the configuration of an EUV light generation system according to an embodiment of this disclosure. As shown in FIG. 2, a laser beam focusing optical system 22*a*, the EUV collector mirror 23, the target collector 28, an EUV collector mirror mount 41, plates 42 and 43, a beam dump 44, and a beam dump support member 45 may be provided inside the chamber 2.

The chamber 2 may include a member, such as an electrically conductive member, formed of a highly electrically conductive material, for example, a metal. The chamber 2 may further include an electrically non-conductive member. In that case, the wall of the chamber 2 may, for example, be constituted by the electrically conductive member, and the electrically non-conductive member(s) may be provided inside the chamber 2. The electrically conductive member such as the wall of the chamber 2 may be connected electrically to the reference potential (0 V) of a DC voltage adjuster 55, or may further be grounded.

The plate 42 may be fixed to the chamber 2, and the plate 43 may be fixed to the plate 42. The EUV collector mirror 23 may be held by the EUV collector mirror mount 41 such that the posture and/or the orientation of the EUV collector mirror 23 are/is adjustable. The EUV collector mirror mount 41 may be fixed to the plate 42.

The laser beam focusing optical system 22*a* may include an off-axis paraboloidal mirror 221 and a flat mirror 222. The off-axis paraboloidal mirror 221 and the flat mirror 222 may be mounted on the plate 43 through respective mirror holders such that a laser beam reflected sequentially by these mirrors 221 and 222 is focused in the plasma generation region 25.

The beam dump 44 may be fixed to the chamber 2 through the beam dump support member 45 such that the beam dump 44 is positioned on an extension of the beam path of the laser beam. The target collector 28 may be provided in the chamber 2 downstream from the plasma generation region 25 in the direction in which targets 27 travel.

The chamber 2 may further include the window 21, the target supply unit 26 of an electrostatic-pull-out type, and a target detector 46. The target supply unit 26 may include a reservoir or target storage unit 61, a nozzle unit 62, and an electrode 66. Electrically conductive metal or the like may be used as the target material. In some embodiments disclosed in this specification, tin (Sn), whose melting point is 232° C., may be used as the target material.

The reservoir 61 may store tin serving as the target material. The nozzle unit 62 may have a through-hole 62*a*, as shown in FIG. 3B, formed therein, which is in communication with the interior of the reservoir 61. The target material stored in the reservoir 61 may be outputted through the through-hole 62*a* formed in the nozzle unit 62. The electrode 66 may be provided to face the nozzle unit 62. When a DC voltage is applied between the electrode 66 and the target material, electrostatic force may act on the target material, and the target material may project through the through-hole 62*a* formed in the nozzle unit 62 and be eventually separated into droplets to form the targets 27. The details of the target supply unit 26 will be given later.

The target detector 46 may be configured to detect a target 27 outputted from the target supply unit 26 passing through a predetermined region. Upon detecting the target 27, the target detector 46 may output a target detection signal to a target control device 52.

A beam delivery unit 34*a* and the EUV light generation controller 5 may be provided outside the chamber 2. The beam delivery unit 34*a* may include high reflection mirrors 341 and 342, holders for the respective mirrors 341 and 342, and a housing in which the mirrors 341 and 342 are disposed. The EUV light generation controller 5 may include an EUV light generation control device 51, the target control device 52, a pressure adjuster 53, an inert gas cylinder 54, the DC voltage adjuster 55, a trigger signal generation circuit 56, and a timer 57.

The pressure adjuster 53 may be configured to adjust the pressure of gas to be applied to the target material stored inside the reservoir 61. As the pressure of gas applied to the target material is adjusted, a generation frequency of the targets 27 may be adjusted. For example, the pressure adjuster 53 may be configured to control the pressure of an inert gas supplied from the inert gas cylinder 54.

The DC voltage adjuster 55 may be configured to control a DC voltage to be applied between the electrode 66 and the target material. As the DC voltage is controlled, the size of the target 27 outputted from the target supply unit 26 may be adjusted. For example, the DC voltage adjuster 55 may include a switching power supply circuit configured to first generate a DC voltage by rectifying an AC voltage supplied from a commercial power supply and then generate a desired DC voltage through DC/DC-conversion of the generated DC voltage.

A target detection signal outputted from the target detector 46 may be inputted to the trigger signal generation circuit 56 through the target control device 52. The trigger signal generation circuit 56 may be configured to generate a trigger signal having a desired delay time with respect to the inputted target detection signal, and output this trigger signal to the laser apparatus 3. The trigger signal may serve to define a timing at which a laser beam is outputted. With this configuration, the target 27 may be irradiated precisely with the laser beam outputted from the laser apparatus 3 in the plasma generation region 25.

The timer 57 may be configured to count clock signals by a quartz resonator or the like to generate a timed value, and output the timed value to the target control device 52. The timed value may be used to calculate a generation frequency of the targets 27.

3.2 Operation

Upon receiving a target output signal from the EUV light generation control device 51, the target control device 52 may output a control signal to initiate generation of the targets 27. More specifically, the target control device 52 may output a control signal to the pressure adjuster 53 such that a pressure inside the reservoir 61 is adjusted to a predetermined pressure. Further, the target control device 52 may output a control signal to the DC voltage adjuster 55 such that a potential difference between the target material and the electrode 66 is brought to a predetermined potential difference.

In accordance with these control signals, the pressure adjuster 53 may adjust the pressure of the inert gas such that the pressure inside the reservoir 61 is adjusted to a predetermined pressure. Further, the DC voltage adjuster 55 may control a DC voltage to be applied between the target material and the electrode 66 such that the potential difference between the target material and the electrode 66 is brought to a predetermined potential difference. With this configuration, the target supply unit 26 may output targets 27 in the form of droplets toward the plasma generation region 25 inside the chamber 2.

The target detector 46 may detect a target 27 passing through a predetermined region, and output a target detection signal to the target control device 52. The target detection signal may include information indicating the size of the targets 27, the generation frequency of the targets 27, and so forth. The target control device 52 may output a control signal to the DC voltage adjuster 55 such that a target 27 of a predetermined size is generated based on the inputted target detection signal. Further, the target control device 52 may output a control signal to the pressure adjuster 53 such that the targets 27 are generated at a predetermined frequency based on the inputted target detection signal.

The target control device 52 may be configured to monitor whether the size of the target 27 and the generation frequency of the targets 27 fall within respective predetermined ranges. When the size of the target 27 and the generation frequency of the targets 27 are detected to fall within the respective predetermined ranges for a predetermined time, the target control device 52 may output a target generation preparation complete signal to the EUV light generation control device 51. Upon receiving the target generation preparation complete signal, the EUV light generation control device 51 may output a signal to set a predetermined delay time in the trigger signal generation circuit 56. This delay time may be set as a time from the point at which the target 27 passing through a predetermined region is detected to the point at which the target reaches the plasma generation region 25 and is irradiated with the laser beam.

Further, the EUV light generation control device 51 may output a gate open signal to the trigger signal generation circuit 56. Upon receiving the gate open signal, the trigger signal generation circuit 56 may output a trigger signal to the laser apparatus 3. Upon receiving the trigger signal, the laser apparatus 3 may output a pulse laser beam in synchronization with the trigger signal.

The pulse laser beam outputted from the laser apparatus 3 may be reflected by the high-reflection mirrors 341 and 342, and enter the laser beam focusing optical system 22*a* through the window 21. The pulse laser beam that has entered the laser beam focusing optical system 22*a* may be reflected by the off-axis paraboloidal mirror 221 and the flat mirror 222. Then, the target 27 may be irradiated with the pulse laser beam. Upon being irradiated with the pulse laser beam, the target 27 may be turned into plasma, and the EUV light may be emitted from the plasma. The emitted EUV light may be reflected by the EUV collector mirror 23 to be focused in the intermediate focus region 292, and outputted to an exposure apparatus.

3.3 Effect

According to this embodiment, the target control device 52 may be configured to control at least one of the DC voltage adjuster 55 and the pressure adjuster 53 based on the detection result of the target detector 46 such that the target 27 of a predetermined size is generated and/or the targets 27 are generated at a predetermined frequency. With this configuration, the size and/or the generation frequency of the targets 27 may be stabilized.

Further, the trigger signal generation circuit 56 may be configured to output the trigger signal to the laser apparatus 3 based on the detection result of the target detector 46. With this configuration, the target 27 may be irradiated precisely with the laser beam outputted from the laser apparatus 3 in the plasma generation region 25.

Since the DC voltage adjuster 55 is configured to apply a DC voltage between the target material and the electrode 66, a variation in the applied voltage among the targets 27 may be reduced compared to the case where a pulse voltage is applied. Accordingly, the size of the targets 27 may further be stabilized.

4. Electrostatic-Pull-Out Type Target Supply Unit 4.1 Configuration

Figure 3A:
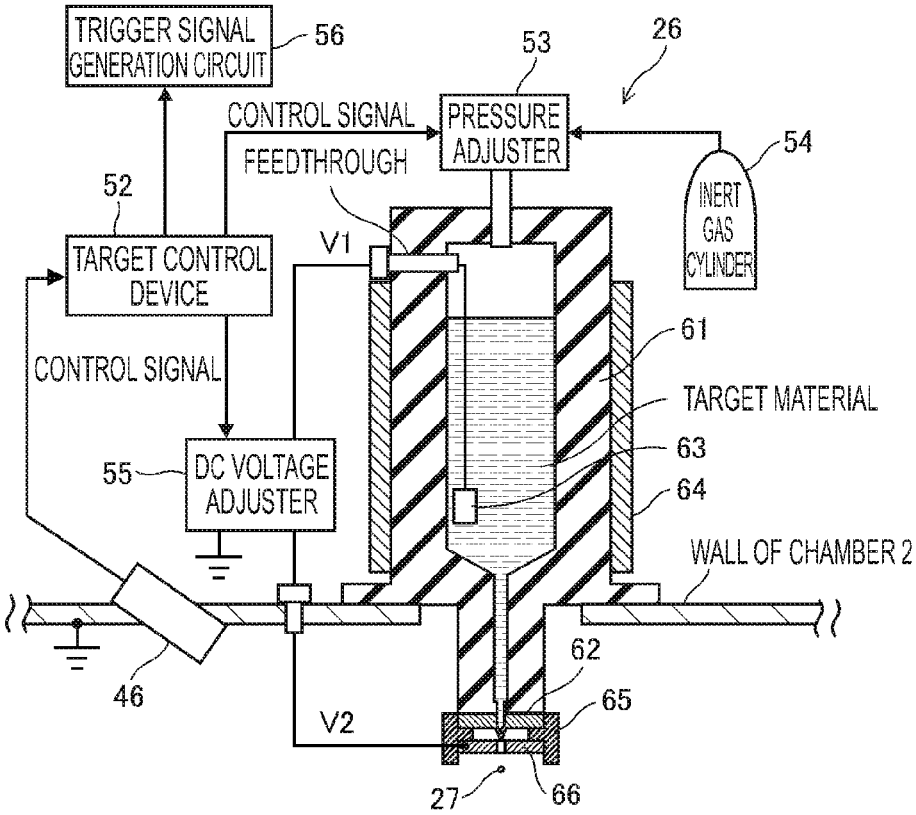
FIG. 3A is a sectional view illustrating a target supply unit shown in FIG. 2 and peripheral components thereof.
Figure 3B:
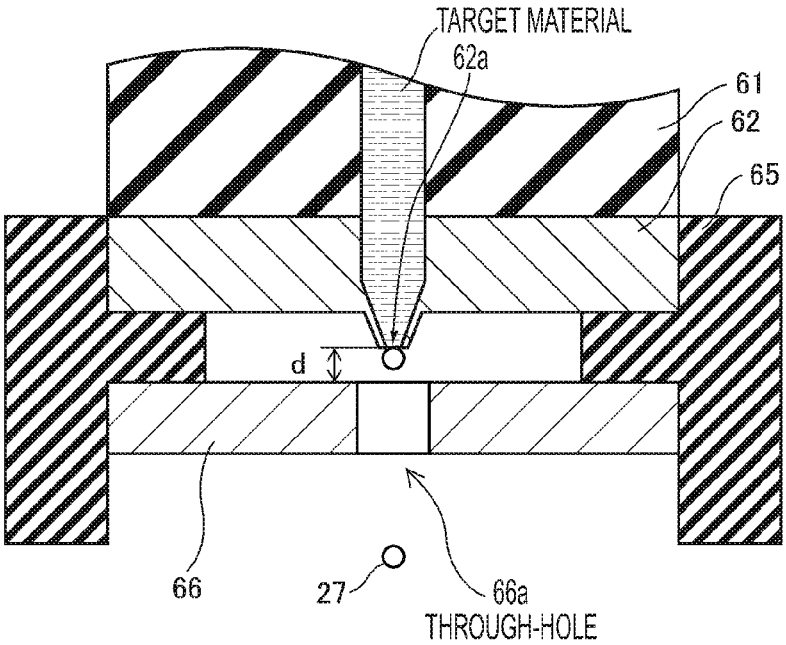
FIG. 3B is an enlarged sectional view illustrating a part of the target supply unit shown in FIG. 3A.

FIG. 3A is a sectional view illustrating a target supply unit shown in FIG. 2 and peripheral components thereof. FIG. 3B is an enlarged sectional view illustrating a part of the target supply unit shown in FIG. 3A.

As shown in FIG. 3A, the target supply unit 26 may include the reservoir 61, the nozzle unit 62, an electrode 63, a heater 64, an electrical insulator 65, and the electrode 66. The reservoir 61 and the nozzle unit 62 may be formed integrally or separately.

The reservoir 61 may be formed of an electrically non-conductive material, such as synthetic quartz, alumina, or the like, and tin serving as the target material may be stored inside the reservoir 61. The heater 64 may be mounted around the reservoir 61, and configured to heat the reservoir 61 to a temperature equal to or higher than the melting point of tin so that tin stored inside the reservoir 61 is kept in a molten state. The heater 64 may be used with a temperature sensor (not shown) configured to detect the temperature of the reservoir 61, a heater power supply (not shown) configured to supply an electric current to the heater 64, and a temperature controller (not shown) configured to control the heater power supply based on the temperature detected by the temperature sensor.

As shown in FIG. 3B, the nozzle unit 62 may have a through-hole or orifice 62*a* formed therein, through which the target material is outputted. The through-hole 62*a* formed in the nozzle unit 62 may be in communication with the interior of the reservoir 61. The nozzle unit 62 may have a tip portion projecting from an outer surface thereof so that an electric field is enhanced at the target material in the tip portion of the nozzle unit 62.

The electrical insulator 65 may be attached to the nozzle unit 62 to hold the electrode 66. The electrical insulator 65 may provide electrical insulation between the nozzle unit 62 and the electrode 66. The electrode 66 may be provided to face the outer surface of the nozzle unit 62 with a predetermined distance d (d>0) secured therebetween. An electric field may be generated between the target material and the electrode 66 in order to pull out the target material through the orifice 62*a* formed in the nozzle unit 62. The electrical insulator 65 may have a through-hole through which the target 27 may travel toward the plasma generation region 25, and the electrode 66 may have a through-hole 66*a* formed therein, through which the target 27 may travel toward the plasma generation region 25.

Referring again to FIG. 3A, wiring connected to one of the output terminals of the DC voltage adjuster 55 may be connected to the electrode 63, which is in contact with the target material, through an airtight terminal, such as a feedthrough provided in the reservoir 61. Wiring connected to the other output terminal of the DC voltage adjuster 55 may be connected to the electrode 66 through a feedthrough provided in the chamber 2.

4.2 Operation

The DC voltage adjuster 55 may be configured to apply a DC voltage between the electrode 63 in the target material and the electrode 66 in order to cause electrostatic force to act on the target material under the control of the target control device 52. For example, the DC voltage adjuster 55 may be configured to generate a potential V1, which is higher than a reference potential V2 (0 V), and apply the positive potential V1 to the target material through the electrode 63 and the reference potential V2 to the electrode 66. Alternatively, the DC voltage adjuster 55 may be configured to generate a potential V1, which is lower than the reference potential V2, and apply the negative potential V1 to the target material and the reference potential V2 to the electrode 66. In either case, a predetermined DC voltage defined by the equation V1-V2 may be applied between the target material and the electrode 66. Alternatively, when the nozzle unit 62 is made of metal, the DC voltage adjuster 55 may apply the DC voltage defined by the equation V1-V2 between the nozzle unit 62 and the electrode 66.

The pressure adjuster 53 may control the pressure of the inert gas supplied from the inert gas cylinder 54. Then, the target material stored inside the reservoir 61 may be pressurized by the inert gas. When the target material is pressurized by the inert gas, the target material may be pushed out through the orifice or through-hole 62*a* formed in the nozzle unit 62.

The target material may project through the orifice or through-hole 62*a* formed in the nozzle unit 62 as being pressurized by the inert gas supplied from the inert gas cylinder 54. In this state, when the DC voltage is applied between the electrode 66 and the target material, the electrostatic force may act on the target material, and the target material projecting from the nozzle unit 62 may be separated into targets 27. In this way, the target material may be outputted as charged targets 27 in the form of droplets.

Here, the size of the target 27 may be determined by the strength of the electrostatic force acting between the target material and the electrode 66. Strong electrostatic force may yield relatively small targets 27 since a target 27 is separated immediately after the target material projects from the nozzle unit 62. On the other hand, weak electrostatic force may yield relatively large targets 27 since a target 27 is separated after the projected portion of the target material grows to a relatively large size.

The electrostatic force that acts between the target material and the electrode 66 may be determined by the DC voltage V1-V2 applied between the target material and the electrode 66. Meanwhile, the generation frequency of the targets 27 may be determined by the pressure applied to the target material inside the reservoir 61. Accordingly, the size of the target 27 may be controlled by controlling the DC voltage V1-V2, and the generation frequency of the targets 27 may be controlled by controlling the pressure applied to the target material.

5. Operation Examples of EUV Light Generation System

Figure 4:
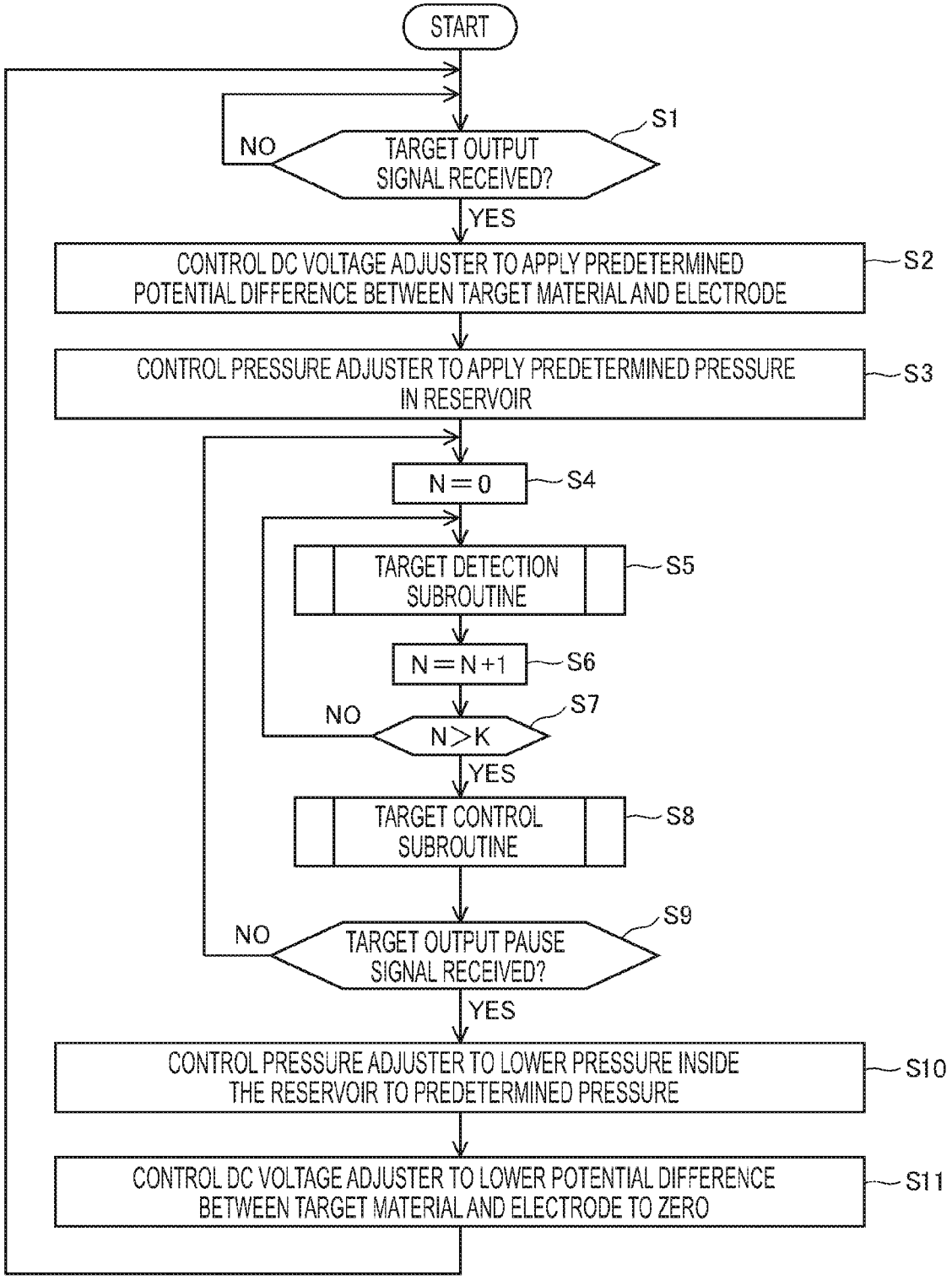
FIG. 4 is a flowchart showing an example of the operation of the EUV light generation system shown in FIG. 2.

The operation of the EUV light generation system will now be described with reference to FIGS. 4 through 6B. FIG. 4 is a flowchart showing an example of the operation of the EUV light generation system shown in FIG. 2.

With reference to FIG. 4, the target control device 52 may determine whether or not a target output signal has been received from the EUV light generation control device 51 (Step S1). When the EUV light generation control device 51 receives an EUV light generation signal from an exposure apparatus or the like, the EUV light generation control device 51 may output a target output signal to the target control device 52. When the target control device 52 has not received the target output signal (Step S1; NO), Step S1 may be repeated. On the other hand, when the target control device 52 has received the target output signal (Step S1; YES), the processing may proceed to Step S2.

Then, the target control device 52 may control the DC voltage adjuster 55, to thereby apply a predetermined potential difference between the target material and the electrode 66 (Step S2). Subsequently, the target control device 52 may control the pressure adjuster 53, to thereby apply predetermined pressure to the interior of the reservoir 61 (Step S3).

Thereafter, the target control device 52 may set a count value N of targets 27 to 0 (Step S4). Then, the target control device 52 may carry out a target detection subroutine, to thereby detect a generation frequency, a diameter, and so forth of the targets 27 (Step S5).

The target control device 52 may then add 1 to the count value N of the targets 27 (Step S6). Subsequently, the target control device 52 may determine whether or not the count value N has exceeded a predetermined value K (Step S7). The predetermined value K may be a preset number of the targets 27 to be outputted, and may be determined accordingly. The predetermined value K may be inputted in advance to the target control device 52, or the target control device 52 may be configured to refer to a value inputted from the EUV light generation control device 51. When the count value N is equal to or smaller than the predetermined value K (Step S7; NO), the processing may return to Step S5. On the other hand, when the count value N has exceeded the predetermined value K (Step S7; YES), the processing may proceed to Step S8.

Thereafter, the target control device 52 may carry out a target control subroutine, to thereby control the generation frequency, the diameter, and so forth of the targets 27 (Step S8).

Upon receiving an EUV light generation pause signal from the exposure apparatus or the like, the EUV light generation control device 51 may output a target output pause signal to the target control device 52. Thus, the target control device 52 may determine whether or not the target output pause signal has been received from the EUV light generation control device 51 (Step S9). When the target control device 52 has not received the target output pause signal (Step S9; NO), the processing may return to Step S4. On the other hand, when the target control device 52 has received the target output pause signal (Step S9; YES), the processing may proceed to Step S10.

Then, the target control device 52 may control the pressure adjuster 53, to thereby lower the pressure inside the reservoir 61 to predetermined pressure (Step S10). Subsequently, the target control device 52 may control the DC voltage adjuster 55, to thereby reduce the potential difference between the target material and the electrode 66 to substantially 0 (Step S11). Thereafter, the processing may return to Step S1.

Figure 5A:
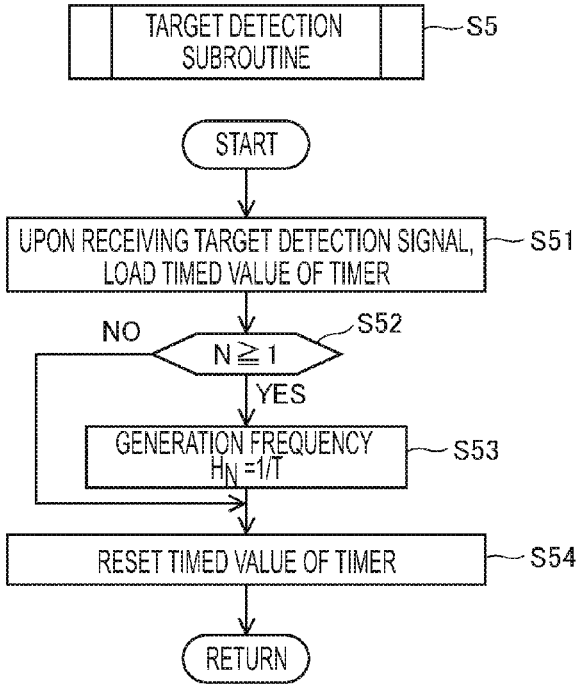
FIG. 5A is a flowchart showing an exemplary target detection subroutine when a generation frequency of targets is to be controlled.

FIG. 5A is a flowchart showing a target detection subroutine when the generation frequency of the targets is to be controlled. In the target detection subroutine to be described below, upon receiving a target detection signal from the target detector 46, the target control device 52 may load a timed value T of the timer 57 (Step S51).

Then, the target control device 52 may determine whether or not the count value N of the targets 27 is equal to or greater than 1 (Step S52). When the count value N is 0 (Step S52; NO), the processing may proceed to Step S54. On the other hand, when the count value N is equal to or greater than 1 (Step S52; YES), the processing may proceed to Step S53.

Subsequently, the target control device 52 may calculate a generation frequency $H_N$ (=1/T) of the targets 27 based on the timed value T of the timer 57 (Step S53). Thereafter, the target control device 52 may reset the timed value T of the timer 57 to 0 (Step S54), and the processing may return to the main routine. In this way, the calculation of the generation frequency of the targets 27 may be carried out for K times, and the K number of calculated values may be obtained.

Figure 5B:
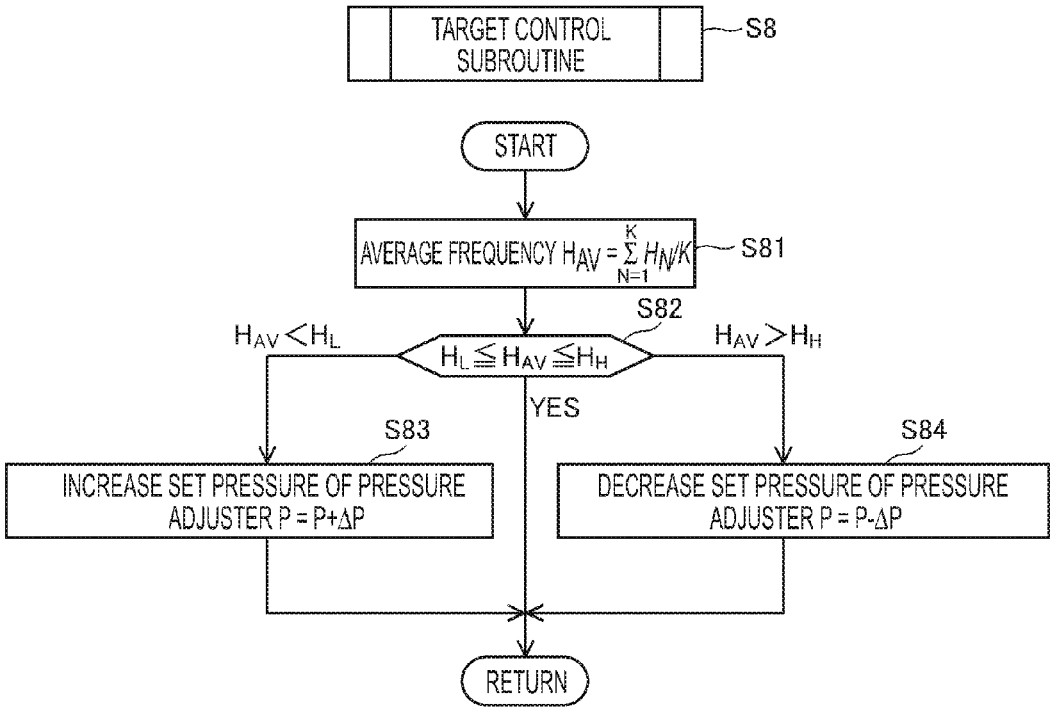
FIG. 5B is a flowchart showing an exemplary target control subroutine when a generation frequency of targets is to be controlled.

FIG. 5B is a flowchart showing a target control subroutine when the generation frequency of the target 27 is to be controlled. In the target control subroutine to be described below, the target control device 52 may add up the K number of calculated values and divide the sum by K, to thereby calculate an average frequency, $H_{AV}$ of the generation frequencies of the targets 27 (Step S81).

Then, the target control device 52 may determine whether the average frequency $H_{AV}$ falls between a predetermined lower limit value $H_L$, inclusive, and a predetermined upper limit value $H_H$, inclusive (Step S82). When the average frequency $H_{AV}$ falls between the predetermined lower limit value $H_L$, inclusive, and the predetermined upper limit value $H_H$, inclusive, the processing may return to the main routine.

When the average frequency $H_{AV}$ is lower than the predetermined lower limit value $H_L$, the processing may proceed to Step S83. Then, the target control device 52 may increase a set pressure P of the pressure adjuster 53 by a predetermined value ΔP (Step S83). With this adjustment, the generation frequency of the targets 27 by the target supply unit 26 may be increased. Thereafter, the processing may return to the main routine. The predetermined value ΔP may be determined through an experiment and inputted to the target control device 52 in advance.

On the other hand, when the average frequency $H_{AV}$ is higher than the predetermined upper limit value $H_H$, the processing may proceed to Step S84. Then, the target control device 52 may decrease the set pressure P of the pressure adjuster 53 by a predetermined value ΔP (Step S84). With this adjustment, the generation frequency of the targets 27 by the target supply unit 26 may be decreased. Thereafter, the processing may return to the main routine.

Figure 6A:
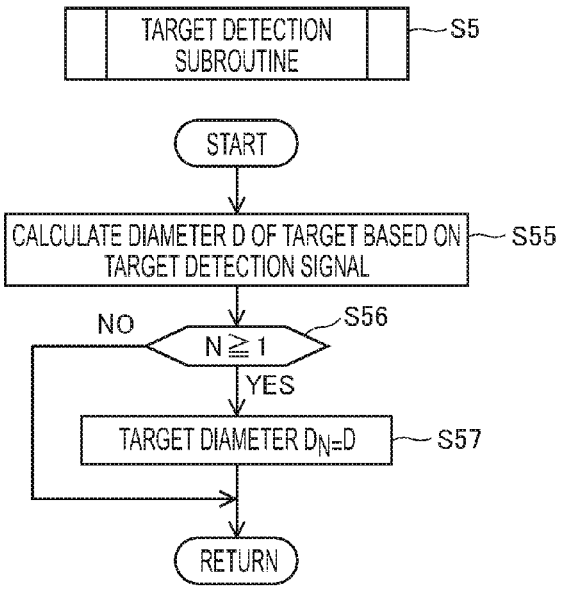
FIG. 6A is a flowchart showing an exemplary target detection subroutine when a diameter of a target is to be controlled.

FIG. 6A is a flowchart showing a target detection subroutine when the diameter of the target is to be controlled. The target control device 52 may calculate a diameter D of a target 27 based on a target detection signal received from the target detector 46 (Step S55).

Then, the target control device 52 may determine whether or not the count value N of the targets 27 is equal to or greater than 1 (Step S56). When the count value N is 0 (Step S56; NO), the processing may return to the main routine.

On the other hand, when the count value N is equal to or greater than 1 (Step S56; YES), the processing may proceed to Step S57. Then, the target control device 52 may plug the diameter D of the target 27 obtained in Step S55 into a diameter $D_N$ of the target 27 obtained through the N-th time calculation (Step S57). Thereafter, the processing may return to the main routine. In this way, the calculation of the diameter D of the target 27 may be carried out for K times, and the K number of calculated values $D_1$ through $D_K$ may be obtained.

Figure 6B:
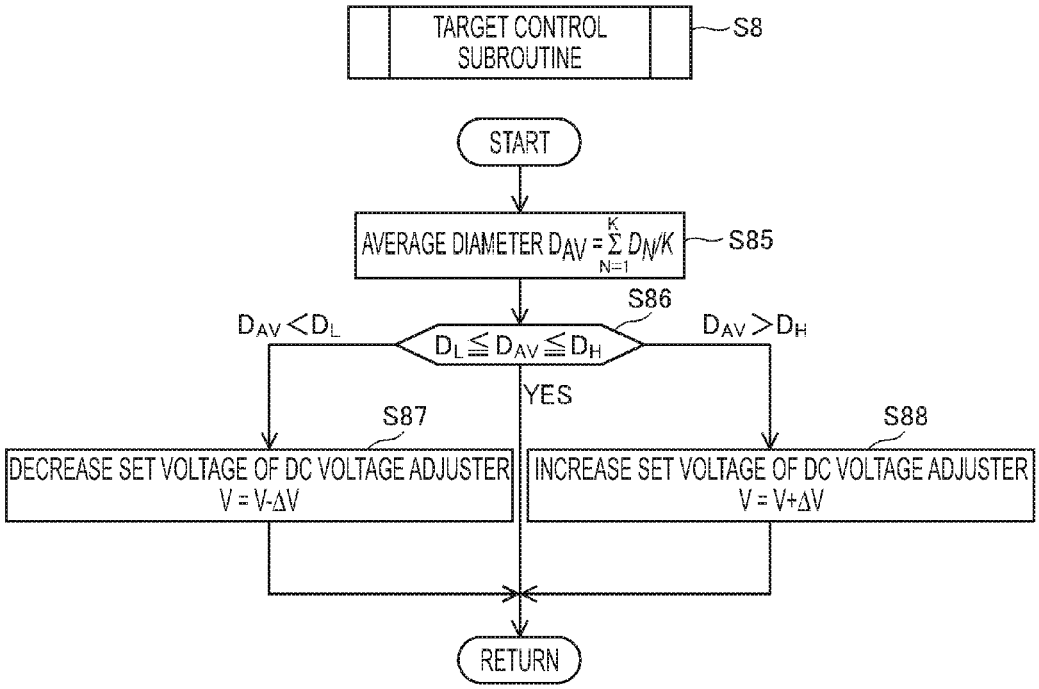
FIG. 6B is a flowchart showing an exemplary target control subroutine when a diameter of a target is to be controlled.

FIG. 6B is a flowchart showing a target control subroutine when the diameter of the target is to be controlled. In the target control subroutine to be described below, the target control device 52 may add up the K number of calculated values $D_1$ through $D_K$ and divide the sum by K, to thereby calculate an average $D_{AV}$ (average diameter) of the diameters of the targets 27 (Step S85).

Then, the target control device 52 may determine whether the average diameter $D_{AV}$ falls between a predetermined lower limit value $D_L$, inclusive, and a predetermined upper limit value $D_H$, inclusive (Step S86). When the average diameter $D_{AV}$ falls between the predetermined lower limit value $D_L$, inclusive, and the predetermined upper limit value $D_H$, inclusive, the processing may return to the main routine.

When the average diameter $D_{AV}$ is smaller than the predetermined lower limit value $D_L$, the processing may proceed to Step S87. Then, the target control device 52 may decrease a set voltage V of the DC voltage adjuster 55 by a predetermined value ΔV (Step S87). With this adjustment, the diameter of the target 27 generated by the target supply unit 26 may be increased. Thereafter, the processing may return to the main routine. The predetermined value ΔV may be determined through an experiment and inputted to the target control device 52 in advance.

On the other hand, when the average diameter $D_{AV}$ is larger than the predetermined upper limit value $D_H$, the processing may proceed to Step S88. Then, the target control device 52 may increase a set voltage V of the DC voltage adjuster 55 by a predetermined value ΔV (Step S88). With this adjustment, the diameter of the target 27 generated by the target supply unit 26 may be decreased. Thereafter, the processing may return to the main routine.

6. Variations of Target Detector 6.1 Optical Target Detector: First Variation

Figure 7A:
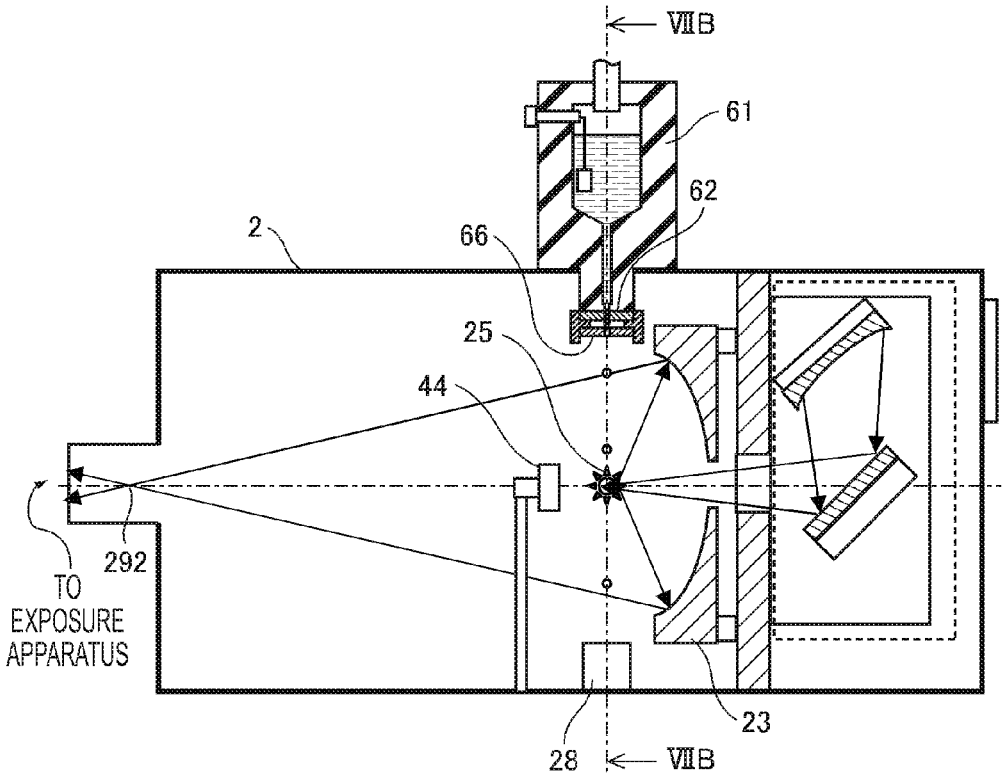
FIG. 7A is a partial sectional view illustrating an EUV light generation system which includes an optical target detector.
Figure 7B:
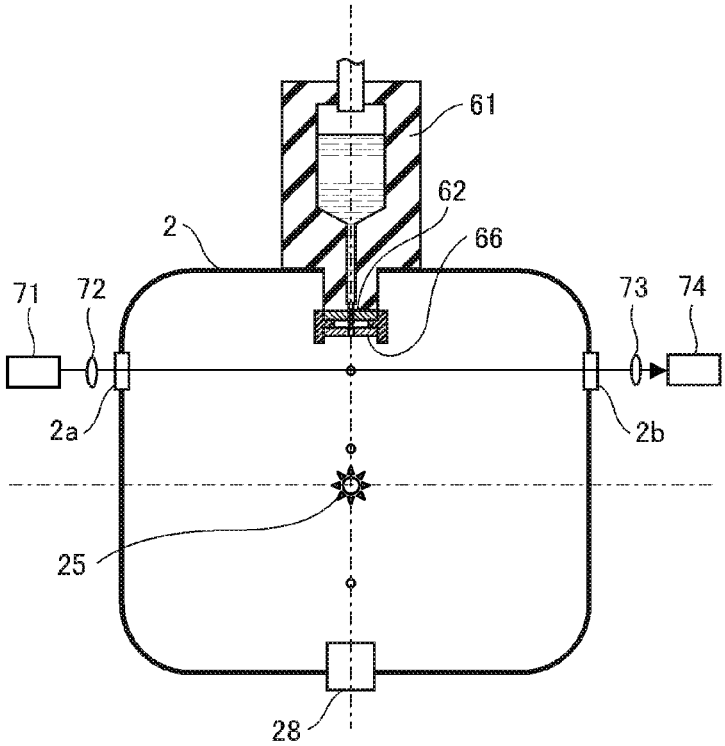
FIG. 7B is a sectional view of the EUV light generation system shown in FIG. 7A, taken along VIIB-VIIB plane.

FIG. 7A is a partial sectional view illustrating an EUV light generation system which includes an optical target detector of a first example. FIG. 7B is a sectional view of the EUV light generation system shown in FIG. 7A, taken along VIIB-VIIB plane. As shown in FIG. 7B, the chamber 2 may further include windows 2*a* and 2*b*. In the first example, an optical target detector may include a light source 71, a first optical system 72, a second optical system 73, and an optical detector 74.

The light source 71 may be a laser device, such as a semiconductor laser, or a lamp light source. Light outputted from the light source 71 may be a sheet beam. The first optical system 72 may include at least one lens or a mirror, and focus the light outputted from the light source 71. The focused light may enter the chamber 2 through the window 2*a*. The target 27 may travel in a direction perpendicular to the direction into which the light that has entered the chamber 2 travels. A part of the light that does not strike the target 27 may enter the second optical system 73 through the window 2*b*.

The second optical system 73 may include at least one lens or a mirror, and focus the entering light on the optical detector 74. The optical detector 74 may be an optical detection element, such as a photodiode, configured to detect the intensity of the incident light, or an imaging device, such as a CCD, configured to detect an image including a shadow of the target 27. With this configuration, the size of the target 27 may be calculated by analyzing the obtained image.

6.2 Optical Target Detector: Second Variation

Figure 7C:
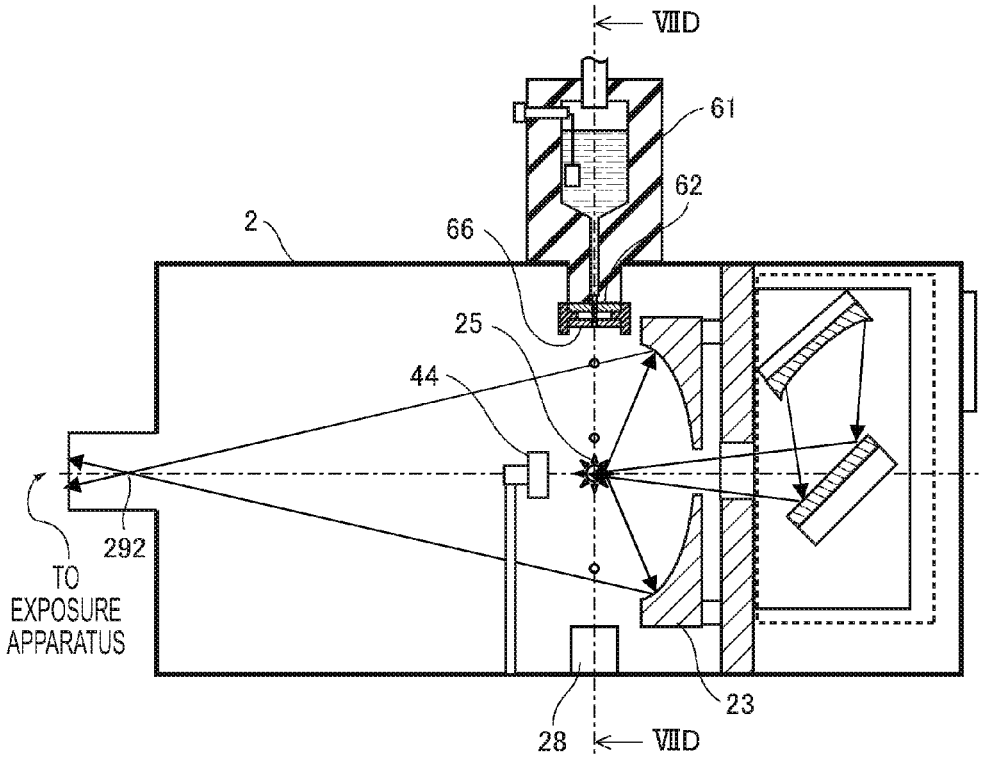
FIG. 7C is a partial sectional view illustrating an EUV light generation system which includes an optical target detector.
Figure 7D:
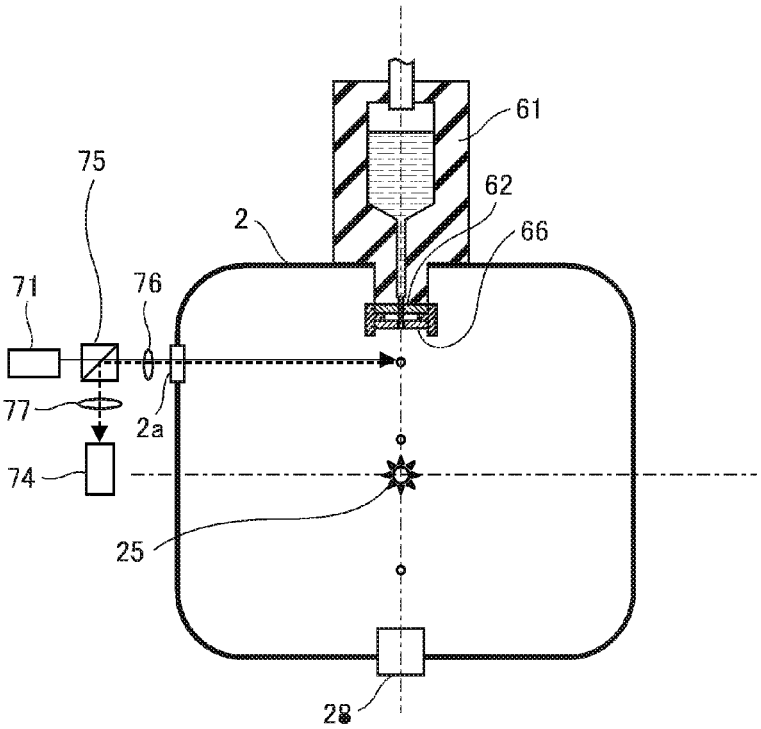
FIG. 7D is a sectional view of the EUV light generation system shown in FIG. 7C, taken along VIID-VIID plane.

FIG. 7C is a partial sectional view illustrating an EUV light generation system which includes an optical target detector of a second example. FIG. 7D is a sectional view of the EUV light generation system shown in FIG. 7C, taken along VIID-VIID plane. As shown in FIG. 7D, the chamber 2 may include the window 2*a*. In the second example, an optical target detector may include the light source 71, the optical detector 74, a beam splitter 75, and optical systems 76 and 77.

The beam splitter 75 may transmit a part of the light outputted from the light source 71. The light from the light source 71 may be a sheet beam. The optical system 76 may include at least one lens or a mirror, and focus the light transmitted through the beam splitter 75. The focused light may enter the chamber 2 through the window 2*a*. A part of the light reflected by the target 27 inside the chamber 2 may again enter the optical system 76 through the window 2*a*. The light transmitted through the optical system 76 may be incident on the beam splitter 75. The beam splitter 75 may reflect a part of the light incident thereon. The light reflected by the beam splitter 75 may enter the optical system 77, and be focused on the optical detector 74 by the optical system 77.

A target detection signal may be a pulsed waveform signal having a certain pulse duration. The target control device 52 (see FIG. 2) may determine a passing timing and a generation frequency of target(s) 27 based on the timing at which the target detection signal is outputted. In the configuration shown in FIG. 7B, the optical detector 74 may output the target detection signal when the light intensity falls below a threshold value. Meanwhile, in the configuration shown in FIG. 7D, the optical detector 74 may output the target detection signal when the light intensity exceeds a threshold value.

When the optical detector 74 is an imaging device, the target control device 52 may be configured to process image data outputted from the optical detector 74 and calculate a diameter of the target 27. Further, the target control device 52 may be configured to process the image data outputted from the optical detector 74 to calculate a distance L between two targets 27, and calculate a generation frequency H of the targets 27 based on the following expression.

$$H=V/L$$

Here, V denotes the speed of the target.

6.3 Magnetic Circuit Target Detector

Figure 8:
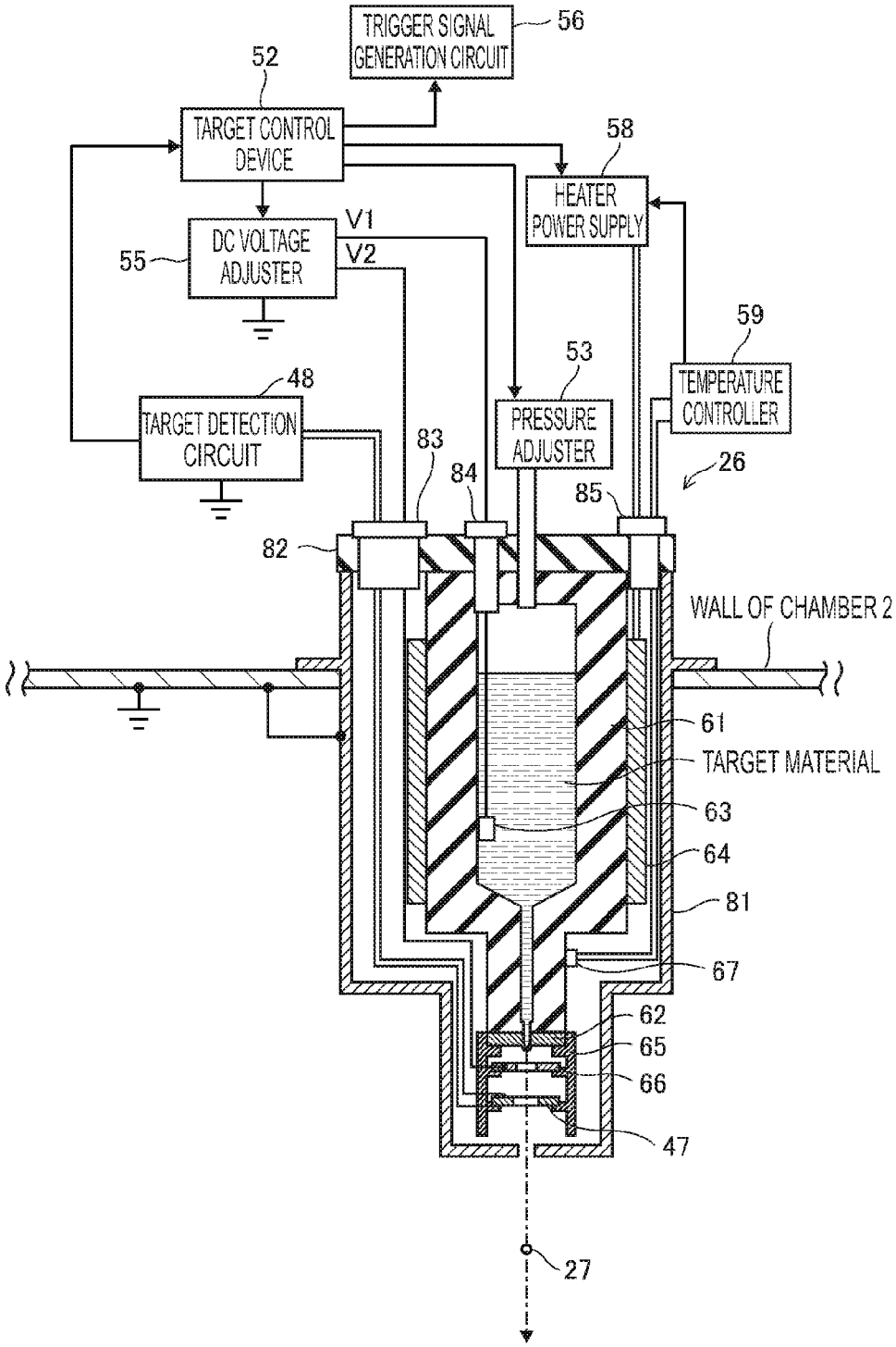
FIG. 8 illustrates a part of an EUV light generation system which includes an magnetic circuit target detector.

FIG. 8 illustrates a part of an EUV light generation system which includes a magnetic circuit target detector. As shown in FIG. 8, a target sensor 47 of a magnetic circuit type may be provided downstream from the electrode 66 in the direction in which the target 27 travels.

Primary constituent elements of the target supply unit 26 shown in FIG. 8 may be housed in a shielding container that includes a shielding cover 81 and a lid 82 attached to the shielding cover 81. The shielding cover 81 may have a through-hole formed therein, through which the targets 27 pass. The shielding cover 81 may serve to shield electrically non-conductive members, such as the electrical insulator 65, from charged particles emitted from plasma generated in the plasma generation region 25.

The shielding cover 81 may be formed of an electrically conductive material, such as a metal, and thus have electrically conductive properties. The shielding cover 81 may be connected directly, or electrically through an electrically conductive connection member, such as a wire, to the electrically conductive member, such as the wall of the chamber 2. The wall of the chamber 2 may be connected electrically to the reference potential of the DC voltage adjuster 55, or may be grounded.

The lid 82 may be formed of an electrically non-conductive material, such as mullite. Further, the target supply unit 26 may include a temperature sensor 67 configured to detect the temperature of the reservoir 61, a heater power supply 58 configured to supply an electric current to the heater 64, and a temperature controller 59 configured to control the heater power supply 58 based on the temperature detected by the temperature sensor 67.

The target sensor 47 may be provided inside the shielding container. A target detection circuit 48 connected to the target sensor 47 may be provided outside the shielding container.

The target sensor 47 may include a magnetic core and a coil wound around the magnetic core. The magnetic core may have a through-hole formed therein, through which the target 27 passes. A closed-loop magnetic circuit may be formed around the through-hole formed in the magnetic core. A magnetic flux may be generated in the magnetic circuit as a charged target 27 passes through the through-hole, and this magnetic flux may generate induced electromotive force in the coil.

The target detection circuit 48 may be configured to detect the induced electromotive force, and output a target detection signal. The target detection signal may be a pulsed waveform signal having a certain pulse duration. The target detection circuit 48 may output the target detection signal when the target 27 outputted through the nozzle unit 62 and having passed through the through-hole 66*a* in the electrode 66 passes through the through-hole formed in the target sensor 47.

Wiring connected to the electrode 66 and wiring connected to the target sensor 47 may respectively be connected to the DC voltage adjuster 55 and the target detection circuit 48 through an airtight terminal 83 provided in the lid 82. Wiring of the electrode 63 may be connected to the DC voltage adjuster 55 through an airtight terminal 84 provided in the lid 82. Wiring connected to the heater 64 and wiring connected to the temperature sensor 67 may respectively be connected to the heater power supply 58 and the temperature controller 59 through an airtight terminal 85 provided in the lid 82.

The target control device 52 may be configured to calculate the passing timing and the generation frequency of the targets 27 based on the timing at which the target detection signal is outputted. Further, the target control device 52 may be configured to calculate the diameter of the target 27 based on the pulse duration of the target detection signal. Here, the arrangement of the target sensor 47 is not limited to the arrangement shown in FIG. 8. The target sensor 47 may be provided at a given point in a moving route of the target 27 between the nozzle unit 62 and the plasma generation region 25.

7. Variation of Target Supply Unit 7.1 Configuration

Figure 9A:
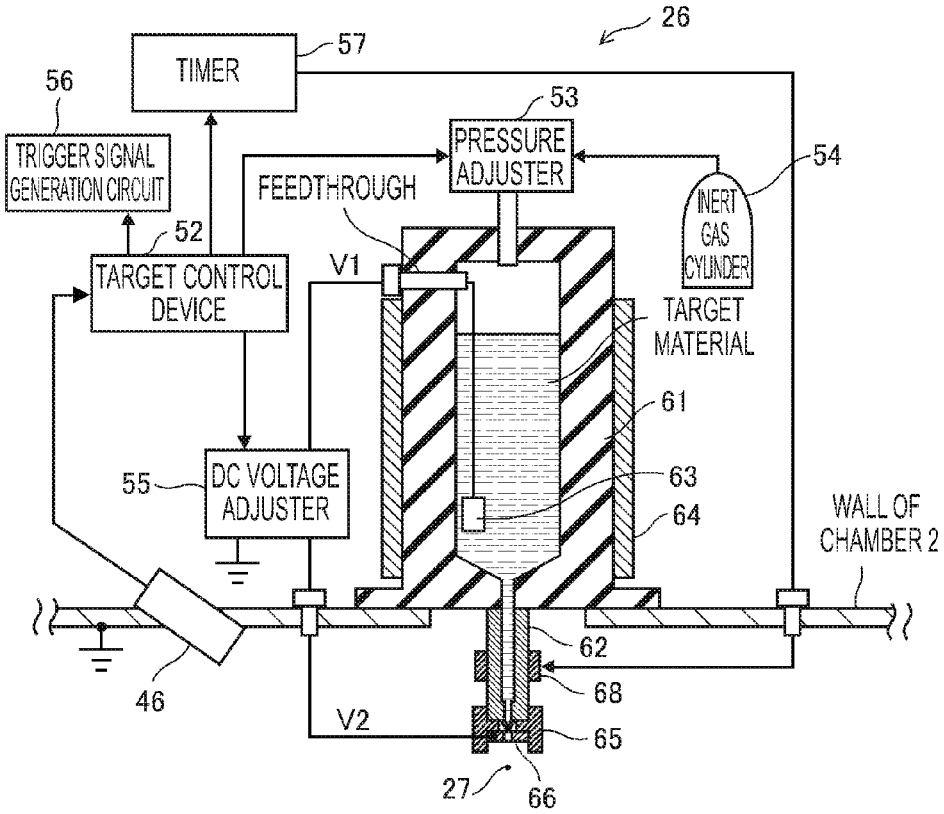
FIG. 9A is a partial sectional view illustrating a modification of the target supply unit shown in FIG. 3A and peripheral components thereof.
Figure 9B:
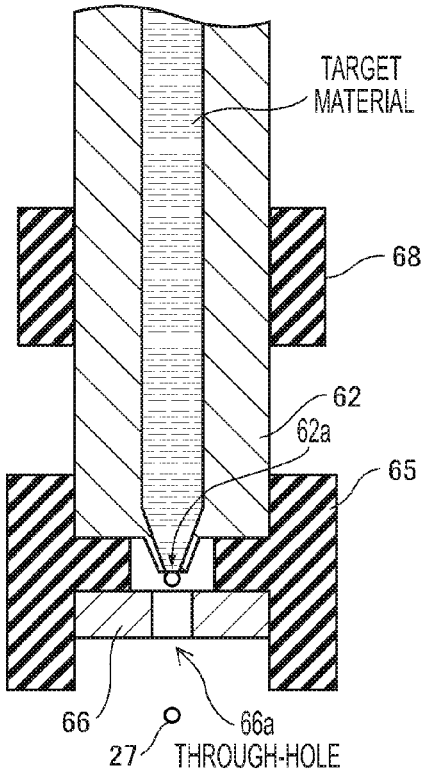
FIG. 9B is an enlarged sectional view illustrating a part of the target supply unit shown in FIG. 9A.

FIG. 9A is a partial sectional view illustrating a modification of the target supply unit shown in FIG. 3A and peripheral components thereof. FIG. 9B is an enlarged sectional view illustrating a part of the target supply unit shown in FIG. 9A. In a target supply unit 26*a*, a piezoelectric element 68 may be attached to the nozzle unit 62 of the target supply unit 26 shown in FIG. 3A. A pulse voltage generation circuit 57 may further be provided to generate a pulse voltage to be applied to the piezoelectric element 68. The target control device 52 may be configured to control the pulse voltage generation circuit 57. Other configurations may be similar to those of the target supply unit 26 shown in FIG. 3A.

The piezoelectric element 68 may include a piezoelectric body, such as lead zirconate titanate (PZT), and at least one pair of electrodes respectively formed on the two surfaces of the piezoelectric body. Alternatively, when the outer surface of the nozzle unit 62 has electrically conductive properties, the outer surface of the nozzle unit 62 may serve as one of the electrodes. The pulse voltage generation circuit 57 may be configured to apply a voltage between the two electrodes of the piezoelectric element 68. The piezoelectric body may deform in accordance with the piezoelectric effect caused by the applied voltage. With this configuration, the piezoelectric element 68 may generate mechanical deformation or vibration in the nozzle unit 62.

7.2 Operation

Upon receiving a target output signal from the EUV light generation control device 51 (see FIG. 2), the target control device 52 may output a control signal to the DC voltage adjuster 55 such that a potential difference between the target material and the electrode 66 is brought to a predetermined potential difference. Then, the target control device 52 may output a control signal to the pressure adjuster 53 such that the pressure applied to the target material inside the reservoir 61 is brought to a predetermined pressure.

Further, the target control device 52 may output a control signal to the pulse voltage generation circuit 57 in order to generate a pulse signal having a predetermined frequency, a predetermine pulse duration, and a predetermined peak voltage at a predetermined timing. The pulse voltage generation circuit 57 may apply a pulse voltage between the two electrodes of the piezoelectric element 68, to thereby cause the piezoelectric element 68 to deform.

When the predetermined voltage is applied to the piezoelectric element 68 by the pulse voltage generation circuit 57, the piezoelectric element 68 may deform, and in turn the nozzle unit 62 may deform by being pushed by the piezoelectric element 68, whereby the target material may project through the through-hole 62*a* formed in the nozzle unit 62. Then, an electric field may be enhanced between the target material projecting through the through-hole 62*a* and the electrode 66, and the electrostatic force therebetween may be increased. When the electrostatic force exceeds the surface tension of the projecting target material, the target material may be separated, and outputted in the form of droplets as the targets 27.

The target detector 46 may be configured to output a target detection signal when the target 27 passes through a predetermined region. The target control device 52 may calculate the timing at which the target 27 passes through the predetermined region based on the target detection signal inputted from the target detector 46, and control the frequency, the pulse duration, the peak voltage, and the generation timing of the pulse voltage in the pulse voltage generation circuit 57 such that the target 27 passes through the predetermined region at a predetermined timing.

Here, the pulse voltage generation circuit 57 may be configured to generate a voltage such that a DC bias voltage is superimposed on a pulse voltage. In this case, the nozzle unit 62 may be kept contracted to some degree in a normal state, and the nozzle unit 62 may be further deformed as necessary. With this configuration, the target material may be pushed out from the nozzle unit 62, or the projecting target material may be pulled back into the nozzle unit 62.

The target control device 52 may calculate the size of the target 27 based on the target detection signal outputted from the target detector 46 either along with, before, or after the control of the pulse voltage generation circuit 57, and control the DC voltage adjuster 55 such that the target 27 of a predetermined size is generated. Further, the target control device 52 may calculate the generation frequency of the targets 27 based on the target detection signal inputted from the target detector 46, and control the pressure adjuster 53 such that the target 27 is generated at a predetermined frequency.

The target control device 52 may monitor whether the size and the generation frequency of the target(s) 27 and the timing at which the target 27 passes through a predetermined region fall within respective predetermined ranges. When the size and the generation frequency of the target(s) 27 and the timing at which the target 27 passes through the predetermined region are detected to fall within the respective predetermined ranges for a predetermine time, the target control device 52 may output a target generation preparation complete signal to the EUV light generation control device 51 (see FIG. 2). Upon receiving the target generation preparation complete signal, the EUV light generation control device 51 may output a signal to the trigger signal generation circuit 56 to set a predetermined delay time. This delay time may be set to a time from the point at which the target 27 passing through a predetermined region is detected to the point at which the target reaches the plasma generation region 25 and is irradiated with a laser beam. Further, the EUV light generation control device 51 may output a gate open signal to the trigger signal generation circuit 56. Based on the gate open signal, the trigger signal generation circuit 56 may output a trigger signal to the laser apparatus 3.

7.3 Effect

In the target supply unit 26*a*, by controlling at least one of the DC voltage adjuster 55, the pressure adjuster 53, and the pulse voltage generation circuit 57 based on the detection result of the target detector 47, the stability in the size and the generation frequency of the targets 27 and in the timing at which a target 27 passes through the predetermined region may be improved. In particular, the target supply unit 26*a* may be configured to be able to generate a target 27 on-demand by controlling the frequency, the pulse duration, the peak voltage, and the generation timing of the pulse voltage applied to the piezoelectric element 68.

Further, the EUV light generation system may be configured such that the trigger signal generation circuit 56 outputs the trigger signal to the laser apparatus 3 based on the detection result of the target detector 46 and the target 27 is irradiated with the laser beam in the plasma generation region 25 with high precision.

Figure 10:
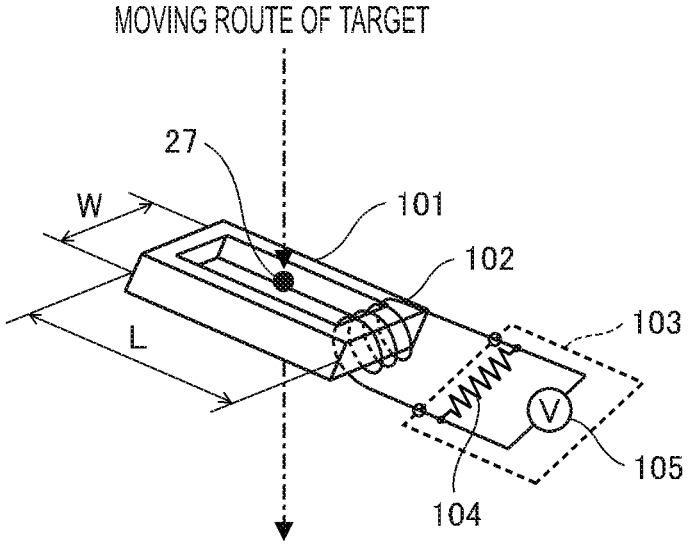
FIG. 10 illustrates an example of the configuration of a target sensor used to detect a charged target.

8. Supplementary Description 8.1 Detection of Charged Target through Magnetic Circuit FIG. 10 illustrates an example of the configuration of a target sensor used to detect a charged target. As shown in FIG. 10, a coil 102 is wound around a magnetic circuit formed by a closed loop of a magnetic core 101, and both ends of the coil 102 may be connected to an ammeter 103. The ammeter 103 may include a resistance 104 connected between two input terminals and a voltmeter 105 configured to measure a voltage between the two ends of the resistance 104. When a charged target 27 moves, a magnetic field may be generated around the target 27 in accordance with Ampere's rule. As the target 27 travels through the closed loop of the magnetic circuit, the magnetic force lines by the magnetic field may pass inside the magnetic circuit. At this time, the induced electromotive force by the electromagnetic induction caused by the magnetic force lines inside the magnetic circuit may be generated at both ends of the coil 102. As a result, an electric current may flow in the coil 102. This electric current may be measured by the ammeter 103, and a timing at which the electric current flows may be detected.

The material for the magnetic core 101 may be a ferromagnet. As the material for the magnetic core 101, ferrite magnet, neodymium magnet, samarium cobalt magnet, soft iron, or the like may be used, for example. Here, the smaller the magnetic circuit is, the larger the electric current flows in the coil 102. Further, the larger the charge amount of the target 27 is, the larger the electric current flows in the coil 102.

As an example, when the diameter of the target 27 is a few tens of μm and the charge amount is a few pC, the dimension of the magnetic core may preferably be around 0.6 mm in width (W) and 0.85 mm in length (L). Further, in order to increase the charge amount of the target 27, an electrostatic pull-out type target supply unit may be used.

In the example shown in FIG. 10, the magnetic core 101 is rectangular in shape; however, without being limited to the shape shown in FIG. 10, the magnetic core 101 may be in any shape such as, circular, polygonal, elliptical, and so forth. That is, the magnetic circuit may be configured so that the magnetic core 101 has a closed loop. Then, the magnetic core 101 may preferably be arranged such that the target 27 travels through the closed loop of the magnetic circuit. Here, when the magnetic circuit is arranged so that the trajectory of the target 27 intersects with the plane where the closed loop of the magnetic circuit lies at an angle other than 90 degrees, the timing at which the target 27 passes through the magnetic circuit may correlate with the position at which the target 27 passes through the plane where the closed loop lies. That is, the position at which the target 27 passes may be calculated based on the timing of a target passing signal. The position at which the target 27 passes may easily be calculated by measuring in advance an output timing of the target 27, a speed of the target 27, a distance between the nozzle 62 and the target sensor 47, an angle at which the target sensor 47 is inclined with respect to the trajectory of the target 27.

The above-described embodiments and the modifications thereof are merely examples for implementing this disclosure, and this disclosure is not limited thereto. Making various modifications according to the specifications or the like is within the scope of this disclosure, and other various embodiments are possible within the scope of this disclosure. For example, the modifications illustrated for particular ones of the embodiments can be applied to other embodiments as well, including the other embodiments described herein.

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. An apparatus used with an external laser apparatus for generating extreme ultraviolet light, the apparatus comprising:

a target storage unit configured to store a target material thereinside;

a nozzle unit having a through-hole through which the target material stored inside the target storage unit is outputted, the through-hole formed therein being in fluid communication with the interior of the storage unit;

an electrode facing the nozzle unit, the electrode having a through-hole formed therein;

a target detector configured to detect a target formed of the target material and output a detection signal;

a chamber in which extreme ultraviolet light is generated;

a direct current voltage adjuster configured to apply a direct current between the target material and the electrode, the direct current voltage adjuster being capable of adjusting the direct current;

a pressure adjuster configured to apply a pressure to the target material through gas, the pressure adjuster being capable of adjusting the pressure; and a controller configured to control at least one of the direct current voltage adjuster and the pressure adjuster based on the detection signal from the target detector.

2. The apparatus according to claim 1, further comprising a trigger signal generation circuit configured to:

delay the detection signal from the target detector; and generate a trigger signal to define a timing at which a laser beam is outputted from the external laser apparatus based on a delayed detection signal.

3. The apparatus according to claim 1, wherein the controller is configured to:

calculate a size of the target based on the detection signal from the target detector; and control the direct current voltage adjuster so that the target of a predetermined size is generated.

4. The apparatus according to claim 1, wherein the controller is configured to:

calculate a generation frequency of the target based on the detection signal from the target detector; and control the pressure adjuster so that the target is generated at a predetermined frequency.

5. The apparatus according to claim 1, further comprising:

a piezoelectric element provided on the nozzle unit; and a pulse voltage generation circuit configured to apply a pulse voltage to the piezoelectric element.

6. The apparatus according to claim 5, wherein the controller is configured to control at least one of the direct current voltage adjuster, the pressure adjuster, and the pulse voltage generation circuit based on the detection signal from the target detector.

7. The apparatus according to claim 5, wherein the controller is configured to:

calculate a timing at which the target passes through a predetermined region based on the detection signal from the target detector; and control the pulse voltage generation circuit so that the target passes through the predetermined region at a predetermined timing.

* * * * *